US006814147B2

(12) United States Patent
Baugh

(10) Patent No.: US 6,814,147 B2
(45) Date of Patent: Nov. 9, 2004

(54) MULTILATERAL JUNCTION AND METHOD FOR INSTALLING MULTILATERAL JUNCTIONS

(75) Inventor: John L. Baugh, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 10/358,915

(22) Filed: Feb. 5, 2003

(65) Prior Publication Data

US 2003/0150617 A1 Aug. 14, 2003

Related U.S. Application Data

(60) Provisional application No. 60/356,712, filed on Feb. 13, 2002.

(51) Int. Cl.[7] ..... E21B 43/10

(52) U.S. Cl. ..... 166/313; 166/50; 166/52; 166/187; 166/207; 166/381

(58) Field of Search ..... 166/50, 52, 313, 166/187, 207, 381

(56) References Cited

U.S. PATENT DOCUMENTS 5,794,702 A * 8/1998 Nobileau ..... 166/380
5,944,107 A 8/1999 Ohmer ..... 166/313
5,964,288 A 10/1999 Leighton et al. ..... 166/207
5,979,560 A 11/1999 Nobileau ..... 166/381
6,138,761 A 10/2000 Freeman et al. ..... 166/313
6,253,852 B1 * 7/2001 Nobileau ..... 166/313
6,257,338 B1 * 7/2001 Kilgore ..... 166/313
6,263,968 B1 7/2001 Freeman et al. ..... 166/313
6,419,026 B1 * 7/2002 MacKenzie et al. ..... 166/381

FOREIGN PATENT DOCUMENTS

WO WO 98/09054 5/1998
WO WO 00/31375 2/2000

* cited by examiner

*Primary Examiner*—David Bagnell
*Assistant Examiner*—Giovanna Collins
(74) *Attorney, Agent, or Firm*—Cantor Colburn LLP

(57) ABSTRACT

A multilateral junction comprises a primary leg and one or more lateral legs. Each end of the primary leg and each lateral leg has an inflatable element therein. A method for installing a multilateral junction includes running a deformed junction to depth and serially or collectively inflating an inflatable element in each leg of said junction to reform said junction.

12 Claims, 1 Drawing Sheet

MULTILATERAL JUNCTION AND METHOD FOR INSTALLING MULTILATERAL JUNCTIONS

CROSS REFERENCE TO RELATED APPLICATIONS

This application claims the benefit of an earlier filing date from U.S. Provisional Application Ser. No. 60/356,712 filed Feb. 13, 2002, the entire disclosure of which is incorporated herein by reference.

BACKGROUND

The hydrocarbon recovery industry has embraced multilateral wellbores to enhance volumetric and qualitative recovery of specified hydrocarbons while minimizing earth surface impact. Multilateral wellbores, simply put, are those where a primary borehole is drilled from the earth's surface and at least one "lateral" borehole diverges from that primary wellbore somewhere underground. As a practical matter, there are more than one lateral borehole extending from a primary borehole.

Multilateral wellbores employ junctions to mate a primary wellbore to its lateral boreholes. Whether the bores be cased or uncased, generally the junction is larger in outside dimension than the primary wellbore through which it must pass to arrive at the site of lateral exit. One way to deal with this issue is to form the junction at the surface and then deform the legs and primary sections thereof so it has a temporary outside dimension smaller than the I.D. of the primary wellbore through which it will be delivered to its installation site. Once at its installation site, the junction is swaged back to near its original shape. Unfortunately, swaging can be damaging to the material of the junction and is effort intensive.

SUMMARY

A multilateral junction comprises a primary leg and one or more lateral legs. Each end of the primary leg and each lateral leg has an inflatable element therein.

A method for installing a multilateral junction includes running a deformed junction to depth and serially or collectively inflating an inflatable element in each leg of said junction to reform said junction.

BRIEF DESCRIPTION OF THE DRAWINGS

Referring now to the drawings wherein like elements are numbered alike in the several Figures.

DETAILED DESCRIPTION

Figure 1:
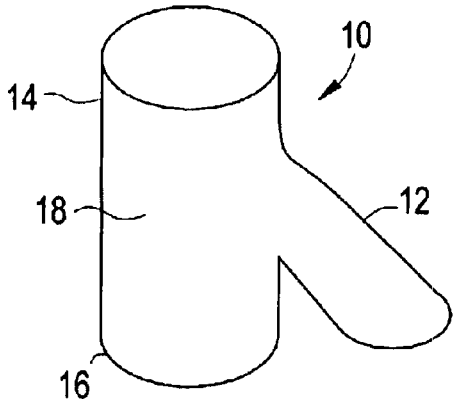
FIG. 1 is a perspective view of a multilateral junction in undeformed condition.
Figure 2:
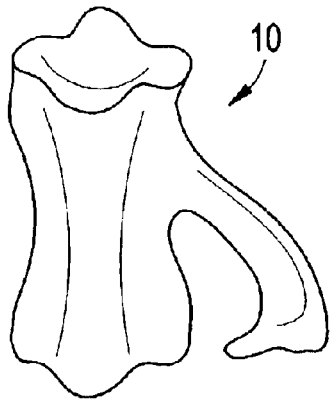
FIG. 2 is a perspective view of a multilateral junction in deformed condition.

Referring initially to FIG. 1, a typical junction shape for installation at the junction between a primary bore and a lateral bore is illustrated. The junction 10 is built prior to being installed in a wellbore, generally at a factory. For the following discussion, different areas of the junction are to be considered separate. They are lateral leg 12, primary end 14, primary end 16 and snobblin bar 18. It is also important to note that for purposes of this application the terms "one end" and "another end" as used with respect to junction 10 are merely used to distinguish between two different areas of the primary borehole section of the junction. They could easily be switched, and have no significance with respect to flow direction or order of the components. A snobblin bar is known in the vernacular of this particular art as that section of a junction having a FIG. 8 appearance where the junction is viewed in cross-section. Such a device as shown in FIG. 1 does not fit through the I.D. of a casing string (not shown) which is generally very slightly larger than the O.D. of, for example, primary end 16. Thus, in order to deliver junction 10 to the desired deployment location it is a practice within the industry to deform the junction as illustrated in FIG. 2.

Reforming the junction after positioning at the desired location is important to its functionality and has been done in the art by means of a mechanical swage. It is desirable however to avoid the work required with the use of a mechanical swage. The inventor of the present disclosure seeks to inflate the deformed junction, as illustrated in FIG. 2, back to a substantial facsimile of its original shape, as illustrated in FIG. 1. The different sections of the junction, i.e., 12, 14, 16 and 18 as identified above require different pressures to undeform them and each has different maximum pressure limits before which such section will rupture. In one example, section 12 would require in excess of 7000 pounds per square inch (hereinafter "psi") to resume a round shape whereas primary end portion 14 only requires 3000 psi to be rendered substantially round and would rupture at pressures significantly above 3000 psi (and well before the 7000 psi required to reform leg 12). Similar to portion 14, primary end portion 16 requires approximately 3000 psi to attain a round shape. Again, substantially in excess of 3000 psi at 16 may cause structural problems with the junction. For obvious reasons then, simply pressuring up on the tubing is not an effective way of reforming the junction. Importantly, the snobblin bar 18 is a relatively weak section of the junction and can only maintain about 2500 psi. Substantially more pressure could easily rupture the snobblin bar.

Figure 3:
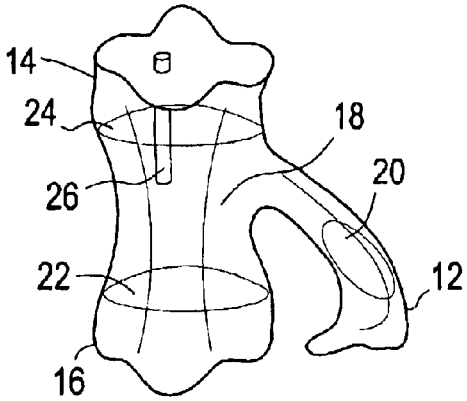
FIG. 3 is a perspective view of FIG. 2 with inflatable elements installed therein.
Figure 4:
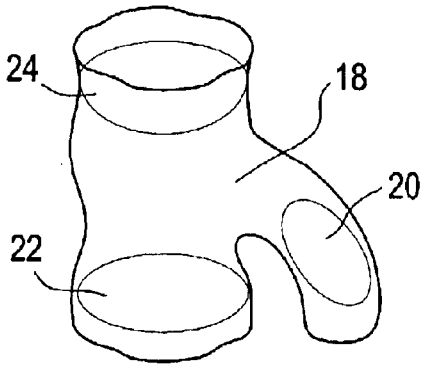
FIG. 4 is a perspective view of the junction with elements inflated.
Figure 5:
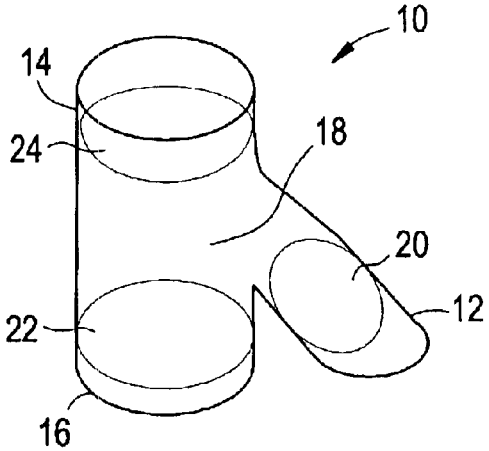
FIG. 5 is a perspective view of the junction with the snobblin bar being pressure reformed.

The inventor hereof has overcome the problem associated with reforming a deformed junction with fluid pressure by employing three separate inflatable elements which can be seen illustrated in situ in FIG. 3. Element 20 is disposed within the lateral section 12 of junction 10, element 22 is located in the primary end 16 and element 24 is located in the primary end 14. In one embodiment, each of the inflatable elements are packers. It is noted that the inflatable elements 20, 22 and 24 are, in this embodiment, installed in the junction after deforming, however, it is possible to have the inflatable elements installed within the junction 10 prior to deforming for ease of insertion. Since each of the elements is independent, different pressures are possible in specific areas of junction 10 which require them. For example, in this embodiment, inflatable element 20 will be pressured to about 7000 psi in order to straighten and round section 12. Inflatable elements 22 and 24 will each be inflated to about 3000 psi in order to reform those sections of the junction. Because elements 22 and 24 are at about 3000 psi, element 20 is reduced from about 7000 psi after inflation, to about 3000 psi. Referring now to FIG. 4, the snobblin bar 18 is at this point segregated and pressure sealed from areas beyond the individual inflatable elements. This area is to be pressured from another location capable of producing and maintaining a pressure of about 2500 psi, i.e., sufficient to reform the snobblin bar area but avoid rupture. This can be accomplished by providing a fluid inlet anywhere within the area defined by inflatable elements 20, 22, 24 and the bridging sections of the junction 10. In this embodiment, inflatable element 24 further includes a feed through arrangement such as that typified by Product number 300-02, commercially available from Baker Oil Tools, Houston, Tex. The feed through device, schematically illustrated at 26, feeds pressure to the snobblin bar area 18. Once the 2500 psi pressure has been given sufficient time, the snobblin bar area of junction 10 is reformed as illustrated in FIG. 5. The inflatable elements may then be removed from the junction and further completion operations undertaken. In one embodiment of the method for creating the junction in the downhole environment, much of which has been disclosed above, the junction 10 is created and then deformed in a pattern known to the art. Inflatable elements are added to the deformed junction although as noted previously can be added prior to deforming. The inflatable elements are inflated either serially or collectively as desired and when set and stabilized, pressure is fed to the snobblin area. After a period of time of about 20 to about 30 minutes, the pressure is relieved from the snobblin area and relieved from the inflatable elements whereafter said elements may be removed from the junction.

While preferred embodiments have been shown and described, modifications and substitutions may be made thereto without departing from the spirit and scope of the invention. Accordingly, it is to be understood that the present invention has been described by way of illustrations and not limitation.

What is claimed is:

1. A multilateral junction comprising:

a primary leg having one end and another end;

one or more lateral legs adjoining said primary leg between said one end and said another end; and an inflatable element in each of said one end of said primary leg, said another end of said primary leg and in each of said one or more lateral legs.

2. A multilateral junction as claimed in claim 1 wherein said inflatable elements in concert and when inflated create a pressure tight space at a snobblin bar of said junction.

3. A multilateral junction as claimed in claim 1 wherein each inflatable element is independently inflatable.

4. A multilateral junction as claimed in claim 1 wherein at least one inflatable element is of a different psi rating.

5. A multilateral junction as claimed in claim 1 wherein said primary leg and said lateral leg are deformed to reduce an outside dimension of said junction.

6. A multilateral junction as claimed in claim 2 wherein said inflatable element in said primary leg further includes a feed-through configured to feed pressure to said space at said snobblin bar.

7. A multilateral junction as claimed in claim 5 wherein said junction is reformable upon pressuring each said inflatable element to a selected pressure and pressuring a space at a snobblin bar of said junction.

8. A multilateral junction as claimed in claim 1 wherein each said inflatable element is a packer.

9. A method for deploying a multilateral junction comprising:

running a deformed junction to depth; and inflating individual inflatable elements in each leg of said junction to undeform said junction.

10. A method for deploying a multilateral junction as claimed in claim 9 wherein said method further comprises pressuring up on a space at a snobblin bar of said junction defined by said individual inflatable elements to undeform said snobblin bar.

11. A method for deploying a multilateral junction as claimed in claim 9 wherein the method further comprises deforming said junction prior to running said junction.

12. A method for deploying a multilateral junction as claimed in claim 9 wherein said inflating is to a pressure calculated to undeform each said leg without rupturing said leg.

* * * * *